United States Patent [19]

McCarthy

[11] Patent Number: 4,981,003

[45] Date of Patent: Jan. 1, 1991

[54] WALL SYSTEM

[75] Inventor: Grant McCarthy, Gibbons, Canada

[73] Assignee: Beaver Plastics Ltd., Edmonton, Canada

[21] Appl. No.: 384,312

[22] Filed: Jul. 24, 1989

[30] Foreign Application Priority Data

Aug. 2, 1988 [CA] Canada ..... 573,544

[51] Int. Cl.[5] ..... E04C 1/00

[52] U.S. Cl. ..... 52/309.7; 52/309.13; 52/309.16

[58] Field of Search ..... 52/309.7, 309.11, 309.13, 52/309.16; 428/120, 327

[56] References Cited

U.S. PATENT DOCUMENTS

| | | | |
|---|---|---|---|
| 2,376,653 | 5/1945 | Boyer | 52/309.11 X |
| 3,353,315 | 11/1967 | Barker | 52/309.11 X |
| 3,449,879 | 6/1969 | Bloom | 52/233 X |
| 3,778,949 | 12/1973 | Hellerich | 52/309.16 X |
| 4,471,591 | 9/1984 | Jamison | 52/309.16 X |

FOREIGN PATENT DOCUMENTS

| | | |
|---|---|---|
| 699650 | 12/1964 | Canada . |
| 756795 | 4/1967 | Canada . |
| 884058 | 10/1971 | Canada . |
| 961427 | 1/1975 | Canada . |
| 977119 | 11/1975 | Canada . |
| 1041728 | 11/1978 | Canada . |
| 1047730 | 2/1979 | Canada . |
| 1049217 | 2/1979 | Canada . |
| 1085131 | 9/1980 | Canada . |
| 1116371 | 1/1982 | Canada . |
| 1169625 | 6/1984 | Canada . |
| 1176815 | 10/1984 | Canada . |
| 1182265 | 2/1985 | Canada . |
| 1207972 | 7/1986 | Canada . |
| 2447845 | 4/1976 | Fed. Rep. of Germany . |

*Primary Examiner*—David A. Scherbel
*Assistant Examiner*—Linda J. Hoffert
*Attorney, Agent, or Firm*—St. Onge Steward Johnston & Reens

[57] ABSTRACT

A unique wall panel is constructed from expanded polystyrene beads in an expanded polystyrene mold with structural members embedded in it during the molding process. The structural members are in the form of two by four studs placed at sixteen inch centers. Adjacent panels have interlocking grooves and ridges which fit together. The advantage of the present invention is that a total insulated wall is created with no cracks or spaces in the insulation. These lightweight panels can be carried to the building site, where base and top plates are applied and the panels interlocked to form a perfectly insulated wall.

11 Claims, 1 Drawing Sheet

WALL SYSTEM

FIELD OF THE INVENTION

This invention relates to wall panels, and more particularly insulated wall panels.

BACKGROUND OF THE INVENTION

In the past, a dwelling would usually be framed on the work site employing standard structural wood members, i.e. two by four studs and two by six support members. Insulation would then be applied between the upstanding studs. Because construction grade lumber is never perfectly straight and even, problems arise when insulation of the expanded polystyrene type is applied between the studs. These must be cut to match the contour of the stud and it is an extremely time consuming process. Moreover, it is less efficient and sometimes impossible to completely insulate around curved or uneven structural members. In order to be more competitive, wall structures have been prebuilt at a lumberyard or some other place of manufacture and then transported to the site. Typically, a box frame is made with two skins, one on either side and insulation placed between. Again, such panels or structures suffer from the inability to completely insulate because of the differences in structural members. Also such structures are fairly heavy to bring to the building site.

More recently, wooden frames have been constructed and polyurethane injected therein. For instance, in Canadian Patent No. 1,176,815, entitled Structural Element for Building Purposes and Method of Making said Element, a box beam element has two spaced apart parallel surface plates and a plurality of longitudinal web plates located between the surface plates and a core of foamed plastic material fills the spaces. Upon hardening, the foam material supports the web plate so as to prevent them from tipping or tilting. The patent however, appears to be directed towards a means to support the web plates in place without nailing or gluing before the foam is pumped in.

In Canadian Patent No. 1,047,730, entitled "Building Panel Element and Method for Manufacturing Same", the frame is constructed with wooden end boards and reinforcing members similar to a standard studded frame. On the opposite side of the plate, thin wood strips are placed. The frame is then filled with foam until the foam rises to be flush with the wood strips thereby incorporating them in the foam.

In both the aforementioned patents, the panel is fairly heavy as some kind of plating or wood strip is necessary to completely contain the foam that is injected within the box. There is therefore a need to develop a lighter wall panel without heavy structural box-like members which have to be taken to the site. There is also a need to have a wall member that is completely insulated but is capable of providing anchorage for outer finishing materials such as siding, or in the case of the inside of the wall, drywall or panelling.

SUMMARY OF THE INVENTION

Therefore, this invention seeks to provide a one-piece molded wall panel constructed of foam insulating thermoplastics including a plurality of structural support members embedded therein.

In a preferred embodiment, this invention provides a wall panel wherein said structural members are parallel to one another and parallel to the side edges of the panel; said structural members extending the entire length of the panel.

DETAILED EXPLANATION OF THE INVENTION

In order to meet these requirements, the present invention provides a wall panel which needs no containment for the injection of foam, as a new inventive method is used. The structural members, such as two by four studs, are placed in an expanded polystyrene mold at predetermined distances from each other, generally extending the length of the panel to be molded. The mold is then injected with expanded polystyrene beads or some other suitable foam insulating material. Molded panels can be made with male and female interlocking side edges so that when the panels are taken to the site, adjacent panels can be connected to form a solid wall.

When the panels are molded, they have only inner structural members which are hidden from view, with the exception of top end and bottom end of the structural members which are flush with the top and bottom of the wall panel. When the panels are taken to the site, a base plate and top plate or header are applied to form a typical studed wall structure which is completely insulated.

A preferred means of construction is to use a mold sixteen feet in length, four feet wide and twenty four inches in depth. Studs are placed in four levels such that after the mold is turned out, it is cut with hot wires to form eight four foot by eight foot panels approximately five and one-half inches thick. The grooves and ribs on the adjacent sides of connecting panels are also cut with hot wires.

In a preferred embodiment, three common two inch by four inch eight foot long studs (generally smaller in both thickness and width) are aligned in parallel relationship with the side edges of the panel. One eight foot stud is located at the midpoint of the panel which is approximately the same width as a standard four by eight building panel. The other two studs are spaced sixteen inches on each side of the midpoint as in typical building construction. There are no studs at the side edges where adjacent panels meet and interlock. The panels meet midway between two studs, one on the right side of one panel and one on the left side of the second panel.

In the case where the side edge of the panel is located at the corner of the frame of a dwelling or construction, the male or female grooves can be squared so that the side edge is smooth, and thus the wall panel can be abutted directly against the upstanding side member.

The preferred material from which the wall panel is constructed is expanded polystyrene beads. It is lightweight, quite strong and has excellent insulating qualities. The panel is generally constructed about five and a half inches in thickness, which is slightly more than an inch and a half wider than the typical stud member. The studs are close enough to the sides to allow sufficient anchorage o either side of the wall panel to attach drywall, outside panelling, or vapour barrier.

BRIEF DESCRIPTION OF THE DRAWINGS

The invention is more fully described in conjuction with the following drawings, wherein.

DETAILED DESCRIPTION OF THE DRAWINGS

Figure 1:
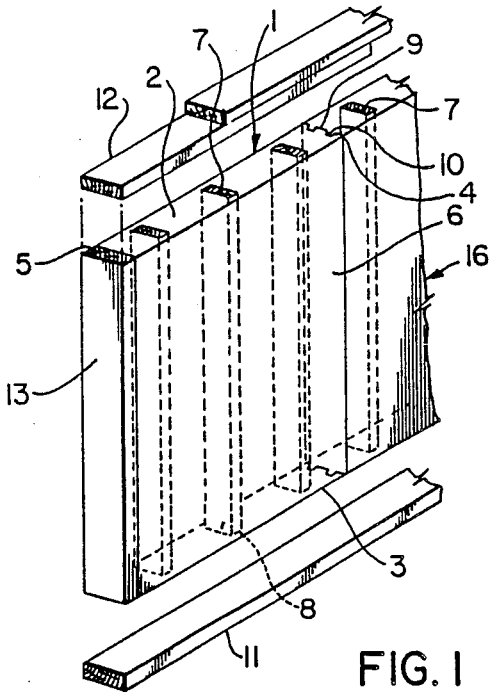
FIG. 1 is a side perspective view of the invention showing one entire wall panel and a partial portion of an adjacent wall panel.

In FIG. 1, a panel 1 is shown. It has a flat squared top end 2 and a squared bottom end 3 as well as front and back faces 6. The right hand side edge 4 has ridges 9 and grooves 10. These are adapted to engage the left hand side edge of an adjacent panel 16. In FIG. 1 the left hand side edge 5 has been trimmed to be flush so that an upstanding end board 13 (two inch by six inch) can be attached. The wall panel 1 and the end board 13 are mounted on a bottom plate 11. The upstanding stud members 7 are hidden from view with the exception that they appear at the squared top end 2 and the squared bottom end 3. A top plate or header board 12, generally in the form of a two inch by six inch board is nailed to the upstanding studs 7 and extends beyond a single wall panel so that upstanding stud members 7 of adjacent panels are secured to the same top plate.

Figure 2:
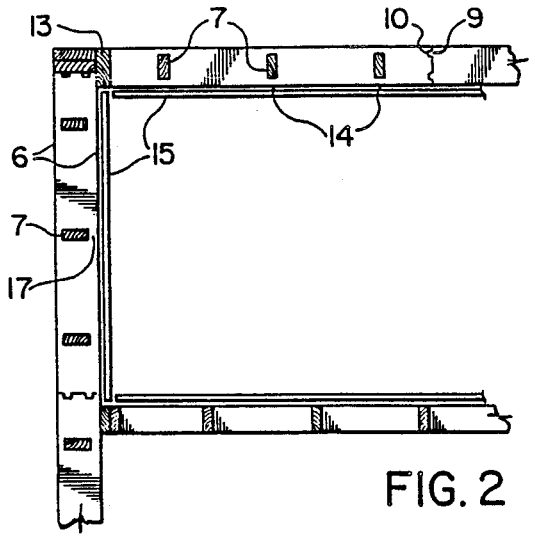
FIG. 2 is a top view of a corner of a dwelling wall embodying a number of panels which are the subject of the present invention.

FIG. 2 is a top view showing a corner of a dwelling where wall panels 1 are employed. Double studs are used at corner intersections and abut against an end board 13. One notes that the studs 7 are completely embedded in the foam 17 and are not visible when the walls have been erected and the bottom plate and top plate are applied. The studs are however close enough to each side so that, for example, drywall 15 can be attached directly against the studded wall at fastening points 14. Similarly, on the outside of the wall panel, outside covering such as panelling or boards can be anchored.

Any number of different configurations can be used without departing from the spirit of the invention. The width, length and thickness of the panels is dependent only on the type of EPS mold used or the configuration in which separate panels are cut with hot wires from a larger molded piece. Similarly, the structural members used therein can be varied according to the end use. Moreover, the interlocking configuration of ridges and grooves could be modified to any configuration which will engage one side of one panel to an adjacent side of another, without departing from the spirit of the invention.

What I claim as my invention is:

1. A one-piece molded wall panel for use as an outside load bearing wall constructed from foam insulating thermoplastics and a plurality of structural support members:

said panel including a thickness being defined by front and back faces thereof, and including a length being defined by top and bottom ends thereof, and including a width being defined by first and second side edges therof;

said structural members being constructed from wood and being surrounded by foam insulating thermoplastics, molded in situ, to substantially eliminate any void spaces between said wooden structural members and said foam insulating thermoplastics;

said wooden structural members being aligned substantially parallel to one another and substantially parallel to said side edges, and said wooden structural members extending the entire length of said panel.

2. A wall panel as claimed in claim 1, wherein said wooden structural members are evenly spaced apart on 16 inch centers.

3. A wall panel as claimed in claim 1, wherein said wooden structural members are evenly spaced apart on 12 inch centers.

4. A wall panel as claimed in claim 1, wherein said wooden structural members are evenly spaced apart on 24 inch centers.

5. A wall panel as claimed in claim 2, comprising three wooden structural members wherein a middle member runs from the midpoint of the top end of said wall panel to the midpoint of the bottom end of said wall panel.

6. A wall panel as claimed in claim 1, wherein said foam insulating thermoplastic is expanded polystyrene beads.

7. A wall panel as claimed in claim 1, wherein one side edge includes at least one groove and the opposite side edge includes at least one ridge; said groove and said ridge extending substantially the entire length of said side edges, and being adapted to engage side edges of adjacent wall panels in an interlocking manner, when in operation.

8. A wall panel as claimed in claim 1, wherein the bottom end and the top end of said panel are square and adapted to be fitted with a base plate and top plate member, respectively, during the construction of a structure.

9. A wall panel as claimed in claim 8, wherein, when said top end and bottom end are fitted with said top plate and said base plate, said wall panel has outside dimensions substantially similar to a foot by 8 foot rectangular panel.

10. A wall panel as claimed in claim 1, wherein said wooden structural members are 2 inch by 4 inch studs positioned with said 2 inch dimension perpendicular to the front and rear faces of said panel to provide anchor points for inner and outer covering materials.

11. A one-piece molded wall panel for use as an outside load bearing wall constructed from foam insulating thermoplastics and a plurality of structural support studs:

said panel including a thickness being defined by front and back faces thereof, and including a length being defined by top and bottom ends thereof, and including a width being defined by first and second side edges thereof;

said structural support studs being surrounded by foam insulating thermoplastics, molded in situ, to substantially eliminate any void spaces between said structural support studs and said foam insulating thermoplastics;

said structural support studs being aligned substantially parallel to one another and substantially parallel to said side edges, and said structural support studs extending the entire length of said panel.

* * * * *